US008106572B2

(12) United States Patent
Tanaka et al.

(10) Patent No.: US 8,106,572 B2
(45) Date of Patent: Jan. 31, 2012

(54) SPARK PLUG AND PROCESS FOR PRODUCING THE SPARK PLUG

(75) Inventors: Tomoo Tanaka, Aichi (JP); Naomichi Miyashita, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 12/735,154

(22) PCT Filed: Dec. 19, 2008

(86) PCT No.: PCT/JP2008/003875
§ 371 (c)(1),
(2), (4) Date: Jun. 18, 2010

(87) PCT Pub. No.: WO2009/081562
PCT Pub. Date: Jul. 2, 2009

(65) Prior Publication Data

US 2010/0264802 A1 Oct. 21, 2010

(30) Foreign Application Priority Data

Dec. 20, 2007 (JP) ..... 2007-328485

(51) Int. Cl.
*H01T 13/20* (2006.01)

(52) U.S. Cl. ..... 313/141; 445/7

(58) Field of Classification Search ..... 313/141; 445/7
See application file for complete search history.

(56) References Cited

U.S. PATENT DOCUMENTS

| | | | | |
|---|---|---|---|---|
| 6,603,244 | B2 * | 8/2003 | Sugiyama et al. | 313/118 |
| 2004/0189169 | A1 * | 9/2004 | Taniguchi et al. | 313/141 |
| 2004/0192155 | A1 * | 9/2004 | Taniguchi et al. | 445/70 |
| 2007/0159046 | A1 * | 7/2007 | Yoshimoto et al. | 313/141 |
| 2007/0290591 | A1 * | 12/2007 | Lykowski et al. | 313/141 |

FOREIGN PATENT DOCUMENTS

| | | |
|---|---|---|
| JP | 5166577 | 7/1993 |
| JP | 11233233 | 8/1999 |
| JP | 2001273966 | 10/2001 |
| JP | 2002237370 | 8/2002 |
| JP | 2002313524 | 10/2002 |
| JP | 2003197346 | 7/2003 |
| JP | 2003197347 | 7/2003 |
| JP | 2005108795 | 4/2005 |
| JP | 2005203121 | 7/2005 |
| JP | 2007227189 | 9/2007 |

OTHER PUBLICATIONS

Form PCT/ISA/210—Int'l Search Report (from corresponding Int'l Patent App. No. PCT/JP2008/003875); 2 pages.

* cited by examiner

*Primary Examiner* — Bumsuk Won
*Assistant Examiner* — Michael Santonocito
(74) *Attorney, Agent, or Firm* — Kusner & Jaffe

(57) ABSTRACT

A spark plug in which an ignition portion of a ground electrode formed through joining of a noble metal chip to the ground electrode has high durability, and a method of manufacturing the spark plug.

4 Claims, 6 Drawing Sheets

FIG. 1(a)
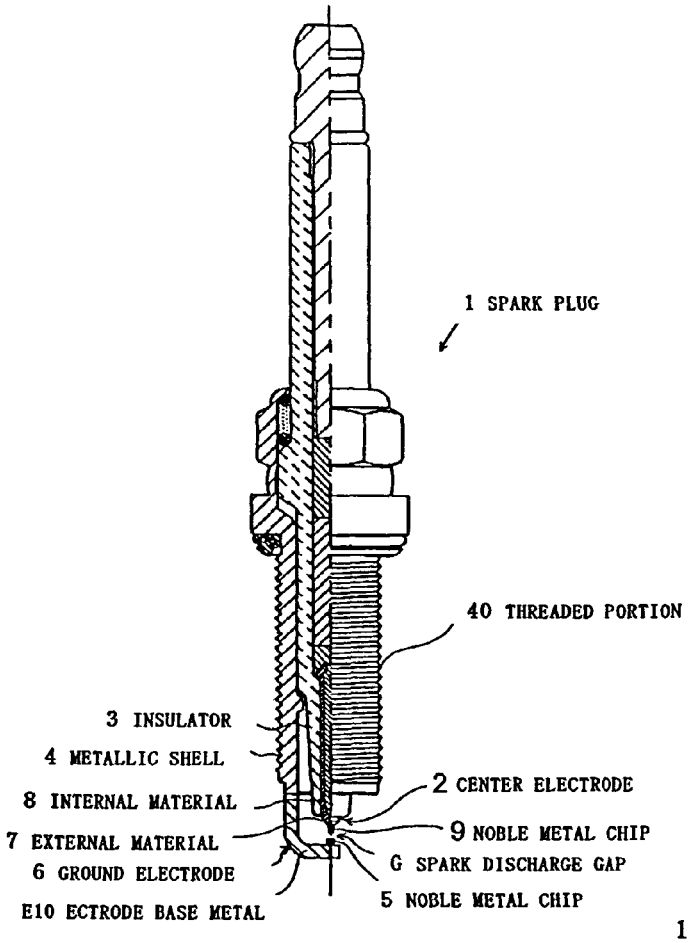
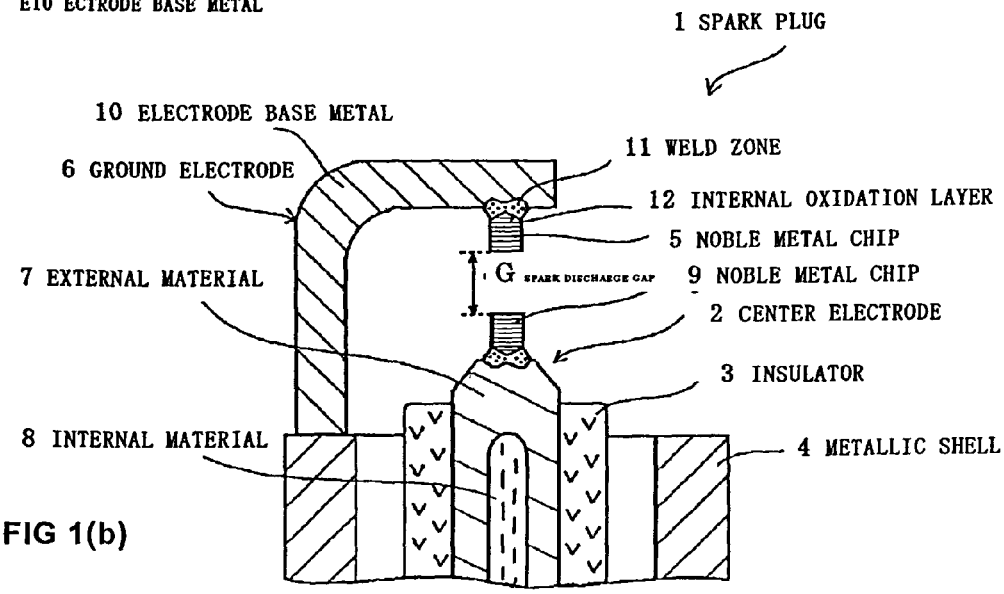
FIG 1(b)

FIG. 2(a)
FIG. 2(b)
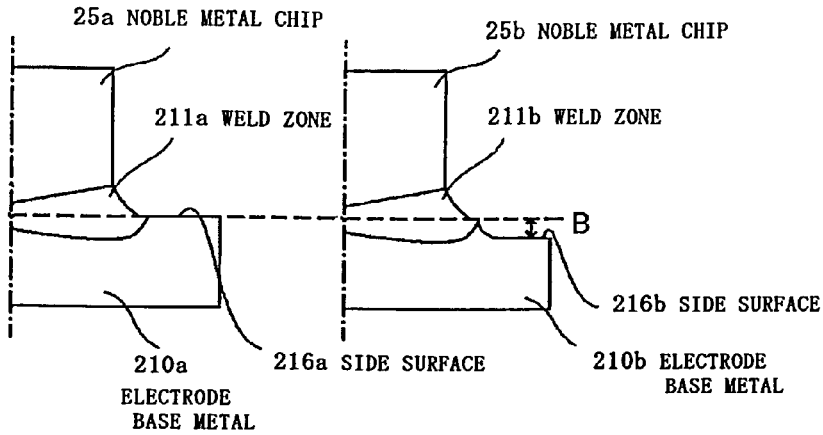
FIG. 3
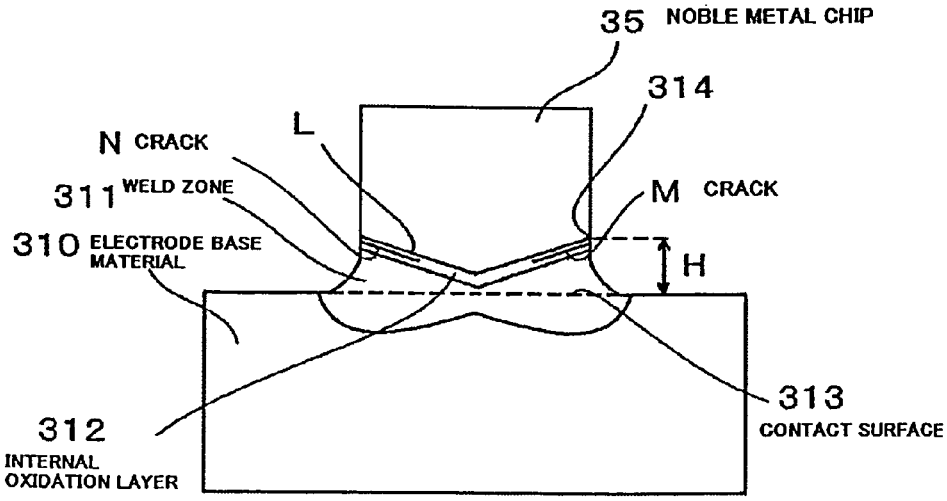

SPARK PLUG AND PROCESS FOR PRODUCING THE SPARK PLUG

FIELD OF THE INVENTION

The present invention relates to a spark plug and a method of manufacturing the spark plug, and more particularly, to a spark plug having a noble metal chip provided on an ignition surface of a ground electrode and a method of manufacturing the spark plug.

BACKGROUND OF THE INVENTION

In recent years, a spark plug used in an internal combustion engine, such as an automobile engine, has a noble metal chip welded to an ignition surface of a front end portion of a center electrode or to an ignition surface of a ground electrode which faces the center electrode, for the purpose of enhancing resistance to spark-induced erosion. The noble metal chip is formed from a noble metal having excellent resistance to spark-induced erosion, such as platinum (Pt), palladium (Pd), or iridium (Ir), or from an alloy which predominantly contains such a noble metal. Meanwhile, a metal having good thermal conductivity, such as a Ni alloy, is used as an electrode base metal of the center electrode or the ground electrode to which the noble metal chip is joined.

The electrode base metal and the noble metal chip have sufficient heat resistance. However, in some cases, as a result of exposure to a high-temperature oxidizing condition and high-temperature heat cycles, cracking has occurred at a joint portion between the electrode base metal and the noble metal chip, and the cracking has progressed, leading to separation or detachment of the noble metal chip. Also, with recent practice of lean burn of fuel and higher degree of compression, a reduction in diameter of the noble metal chip has been required, and the electrode temperature is showing a tendency to increase. As a result, load imposed on the joint portion between the electrode base metal and the noble metal chip is increasing; thus, the noble metal chip is more apt to be separated or detached from the electrode base metal. In order to cope with the situation, various attempts have been made to strongly join the electrode base metal and the noble metal chip.

Japanese Patent No. 3121309 specifies the dimensions of a weld metal layer formed between a noble metal chip and a center electrode or a ground electrode for providing a high-performance, long-life spark plug having excellent strength of joining at the weld metal layer for an internal combustion engine.

Japanese Patent No. 3702838 specifies the shape of a weld metal zone where a noble metal chip and a ground electrode are fused, and the dimensions and components of the noble metal chip in order to provide a spark plug which exhibits enhanced joint performance between the ground electrode and the noble metal chip while ensuring ignitability.

Japanese Patent Application Laid-Open (kokai) No. 2002-237370 specifies the dimensions of a full-circle laser weld zone which extends into a noble metal chip and into a chip mounting surface region, for providing a spark plug having enhanced durability of an ignition portion.

Meanwhile, a ground electrode is disposed deeper in a combustion chamber than is a center electrode. Thus, the ground electrode becomes higher in temperature than the center electrode; i.e., the ground electrode is disposed in a severe environment involving great temperature fluctuations.

Therefore, there has been greater demand for measures to prevent separation or detachment of the noble metal chip from the ground electrode.

An object of the present invention is to provide a spark plug in which an ignition portion of a ground electrode formed through joining of a noble metal chip to the ground electrode has high durability, and a method of manufacturing the spark plug, and particularly, to provide a spark plug which exhibits good joint performance between the noble metal chip and an electrode base metal of the ground electrode, and a method of manufacturing the spark plug.

SUMMARY OF THE INVENTION

In accordance with the present invention, there is provided a spark plug comprising:

a center electrode;

an insulator provided around a periphery of the center electrode;

a metallic shell which holds the insulator; and a ground electrode configured such that one end of an electrode base metal of the ground electrode is joined to an end portion of the metallic shell, a noble metal chip is joined to the other end of the electrode base metal, and a tip end surface of the noble metal chip and a front end surface or a side surface of the center electrode face each other via a spark discharge gap;

wherein the noble metal chip has an average hardness of Hv260 to Hv650 inclusive imparted thereto through work hardening;

the electrode base metal is formed from a Ni alloy which contains Cr in an amount of 15% by mass to 30% by mass inclusive and Al in an amount of 1.5% by mass to 4% by mass inclusive;

a total mass of Ni, Cr, Al, Si, and Fe contained in a weld zone provided between the noble metal chip and the electrode base metal is 5% by mass to 35% by mass inclusive based on a total mass of the weld metal zone;

the average hardness of the noble metal chip is higher than an average hardness of the weld metal zone, and the average hardness of the weld metal zone is higher than an average hardness of the electrode base metal; and the average hardness of the weld metal zone is Hv255 to Hv400 inclusive.

In accordance with another aspect of the present invention, there is provided a spark plug as defined above, wherein a total mass of Cr, Al, Si, and Fe contained in the weld zone is 3% by mass to 9.5% by mass inclusive with respect to the total mass of the weld zone.

In accordance with another aspect of the present invention, there is provided a spark plug as defined above, wherein a total mass of Cr, Al, and Si contained in the weld zone is 2% by mass to 4% by mass inclusive with respect to the total mass of the weld zone.

In accordance with yet another aspect of the present invention, there is provided a spark plug as defined above, wherein the weld zone is formed through joining of the noble metal chip to the electrode base metal by laser welding, and the laser welding is performed by means of radiating a laser pulse of 3 milliseconds or shorter a plurality of times.

In accordance with another aspect of the present invention, there is provided a method of manufacturing a spark plug comprising:

a center electrode;

an insulator provided around a periphery of the center electrode;

a metallic shell which holds the insulator; and a ground electrode configured such that one end of its electrode base metal formed from an Ni alloy which contains Cr in an amount of 15% by mass to 30% by mass inclusive and Al in an amount of 1.5% by mass to 4% by mass inclusive is joined to an end portion of the metallic shell, a noble metal chip having an average hardness of Hv260 to Hv650 inclusive imparted thereto through work hardening is joined to the other end of the electrode base metal, and a tip end surface of the noble metal chip and a front end surface or a side surface of the center electrode face each other via a spark discharge gap;

wherein the noble metal chip is joined to an end portion of the electrode base metal opposite an end portion of the electrode base metal joined to the metallic shell, by laser welding in which a laser pulse of 3 milliseconds or shorter is radiated a plurality of times.

In accordance with still another aspect of the present invention, there is provided a method of manufacturing a spark plug, comprising the steps of:

joining an end portion of an electrode base metal formed from an Ni alloy which contains Cr in an amount of 15% by mass to 30% by mass inclusive and Al in an amount of 1.5% by mass to 4% by mass inclusive, to an end portion of a metallic shell;

assembling a center electrode and an insulator into the metallic shell; and joining a noble metal chip having an average hardness of Hv260 to Hv650 inclusive imparted thereto through work hardening, to an end portion of the electrode base metal opposite the end portion of the electrode base metal joined to the metallic shell, by laser welding in which a laser pulse of 3 milliseconds or shorter is radiated a plurality of times.

Since the electrode base metal of the ground electrode of the spark plug according to the present invention is formed from an Ni alloy which contains Cr in an amount of 15% by mass to 30% by mass inclusive and Al in an amount of 1.5% by mass to 4% by mass inclusive, oxidation of the electrode base metal can be prevented. Accordingly, there can be prevented a relative increase in the height, above the surface of the electrode base metal of the noble metal chip which is joined to the electrode base metal in such a manner as to project from the surface of the electrode base metal, which relative increase could otherwise result from a reduction in the thickness of the electrode base metal caused by oxidation of the electrode base metal. Therefore, there can be prevented separation or detachment of the noble metal chip from the electrode base metal, which could otherwise result from exposure to thermal cycles and impact associated with ignition.

Also, in the spark plug according to the present invention, the total mass of Ni, Cr, Al, Si, and Fe contained in the weld zone provided between the noble metal chip and the electrode base metal is 5% by mass to 35% by mass inclusive with respect to the total mass of the weld metal zone. Thus, it is possible to prevent a generation of an internal oxidation layer in an interface between the noble metal chip and the weld zone. As a result, even in an exposure to thermal cycles within the internal combustion engine, a cracking generated in the internal oxidation layer can be prevented. Since the average hardness of the weld zone is Hv255 to Hv400 inclusive, there can be prevented the generation of cracking in the weld zone induced by an exposure to thermal cycles in the internal combustion engine, even though a distortion caused by difference in thermal expansion coefficient between the noble metal chip and the weld zone occurs.

Further, since the noble metal chip has an average hardness of Hv260 to Hv650 inclusive imparted thereto through work hardening, the generation of cracking can be prevented in the noble metal chip, which cracking could otherwise result from tensile stress which is generated in the side surface of the noble metal chip by the influence of thermal cycles.

Since the noble metal chip is higher in average hardness than the weld zone, which in turn is higher in average hardness than the electrode base metal, a breakage of the noble metal chip can be prevented. Further, the cracking generated in the internal oxidation layer in the interface between the noble metal chip and the weld zone is prevented from extending.

Thus, according to the present invention, an increase in the amount of projection of the noble metal chip can be restrained, and erosion of the weld metal zone can be restrained. Therefore, there can be prevented separation or detachment of the noble metal chip from the electrode base metal. As a result, a spark plug having good joint performance between the electrode base metal and the noble metal chip and high durability can be provided.

The method of manufacturing a spark plug according to the present invention can readily manufacture a spark plug which yields the above-mentioned effects.

BRIEF DESCRIPTION OF THE DRAWINGS

FIG. 1(*a*) is a partially sectional, explanatory view showing an entire spark plug according to an embodiment of the present embodiment, and FIG. 1(*b*) is a sectional, explanatory view showing essential portions of the spark plug according to the embodiment of the present invention.

FIG. 2(*a*) is an enlarged half sectional, explanatory view showing a noble metal chip and an electrode base metal as viewed before a thermal cycle test, and FIG. 2(*b*) is an enlarged half sectional, explanatory view showing the noble metal chip and the electrode base metal as viewed after the thermal cycle test.

FIG. 3 is an enlarged sectional, explanatory view showing a joint portion of the noble metal chip and the electrode base metal.

DETAILED DESCRIPTION OF PREFERRED EMBODIMENTS

Figures 4, 4B:
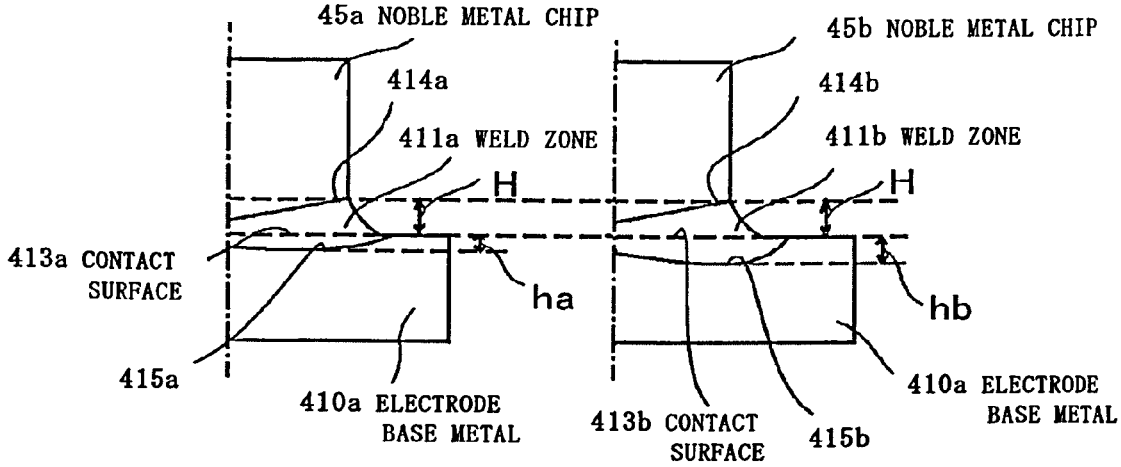
FIG. 4(*a*) is a half sectional, explanatory view showing the noble metal chip and the electrode base metal in the case where the amount of melting of an Ni alloy used to form the electrode base metal is small, and FIG. 4(*b*) is a half sectional, explanatory view showing the noble metal chip and the electrode base metal in the case where the amount of melting of an Ni alloy used to form the electrode base metal is large.

FIG. 1 shows a spark plug according to an embodiment of the present invention. FIG. 1(*a*) is a partially sectional, explanatory view showing an entire spark plug of the present embodiment. FIG. 1(*b*) is a sectional, explanatory view showing essential portions of the spark plug of the present embodiment. In the following description with reference to FIG. 1(*a*), a downward direction on the paper on which FIG. 1(*a*) appears is referred to as a frontward direction along an axis, and an upward direction on the paper is referred to as a rearward direction along the axis. Also, in the following description with reference to FIG. 1(*b*), an upward direction on the paper on which FIG. 1(*b*) appears is referred to as a frontward direction along the axis, and a downward direction on the paper is referred to as a rearward direction along the axis. As shown in FIGS. 1(*a*) and 1(*b*), a spark plug 1 includes a substantially rodlike center electrode 2; a substantially cylindrical insulator 3 provided around the periphery of the center electrode 2; a cylindrical metallic shell 4 which holds the insulator 3; and a ground electrode 6 configured such that one end of an electrode base metal 10 is joined to an end portion of the metallic shell 4, a noble metal chip 5 is joined to the other end of the electrode base metal 10, and the tip end surface of the noble metal chip 5 and the front end surface of the center electrode 2 face each other via a spark discharge gap G.

The metallic shell 4 has a cylindrical shape and is formed so as to hold the insulator 3 inserted thereinto. The metallic shell 4 has a threaded portion 40 formed on the outer circumferential surface of its portion corresponding to a front end portion of the spark plug 1. Through utilization of the threaded portion 40, the spark plug 1 is mounted to a cylinder head (not shown) of an internal combustion engine.

The metallic shell 4 can be formed from an electrically conductive steel material, such as low-carbon steel.

The insulator 3 is held by an inner circumferential face of the metallic shell 4 via talc, packing, or the like and has an axial bore which extends along its axis and holds the center electrode 2 therein. The insulator 3 is fixed in the metallic shell 4 in such a manner that a front end portion thereof projects from the front end surface of the metallic shell 4.

The insulator 3 may be formed from a material which has poor heat conductivity. An example of such material is a ceramic sintered body which predominantly contains alumina.

The center electrode 2 is composed of an external material 7, an internal material 8, which is concentrically embedded in an axial portion of the external material 7, and a noble metal chip 9 joined to the front end surface of the external material 7. The center electrode 2 is a circular columnar body and is fixed in the axial bore of the insulator 3 in such a manner that its front end portion projects from the front end surface of the insulator 3, thereby being held in place while being electrically insulated from the metallic shell 4. A front end portion of the center electrode 2 has a truncated-cone portion whose diameter reduces frontward. The noble metal chip 9 having a circular columnar shape is welded to the front end surface of the truncated-cone portion of the external material 7 by appropriate welding means, such as laser welding or electric resistance welding. The noble metal chip 9 has a diameter smaller than that of the truncated-cone portion. Preferably, the noble metal chip 9 of the center electrode 2 has a circular columnar shape and a diameter of 0.3 mm to 1.5 mm and a height of 0.4 mm to 2.5 mm.

The external material 7 is a metallic material having excellent heat resistance and corrosion resistance, such as a Ni alloy. The internal material 8 is a metallic material having excellent thermal conductivity, such as copper (Cu) or silver (Ag).

The ground electrode 6 assumes the form of, for example, a rectangular columnar body. The ground electrode 6 is composed of the electrode base metal 10, whose one end is joined to an end portion of the metallic shell 4 and which is bent at an intermediate position to have a shape resembling the letter L, and the circular columnar noble metal chip 5 joined to the side surface of the other end of the electrode base metal 10. The shape and structure of the ground electrode 6 are designed such that the tip end surface of the noble metal chip 5 and the front end surface of the center electrode 2 face each other via a spark discharge gap G. FIGS. 1(*a*) and 1(*b*) show an example of the ground electrode.

The spark discharge gap G is a gap between the tip end surface of the noble metal chip 9 of the center electrode 2 and the tip end surface of the noble metal chip 5 of the ground electrode 6. The spark discharge gap G is usually set to 0.3 mm to 1.5 mm. In the case where the center electrode 2 does not have the noble metal chip 9, the spark discharge gap G is a gap between the front end surface of the center electrode 2 and the tip end surface of the noble metal chip 5 of the ground electrode 6, and is usually set to 0.3 mm to 1.5 mm.

The electrode base metal 10 is formed from a Ni alloy which contains Ni as a main component, as well as Cr, Al, Si, and Fe. The Ni alloy contains Cr in an amount of 15% by mass to 30% by mass inclusive and Al in an amount of 1.5% by mass to 4% by mass inclusive. Preferably, the Ni alloy contains Cr in an amount of 20% by mass to 25% by mass inclusive and Al in an amount of 2% by mass to less than 3% by mass. By virtue of having a Cr content of 15% by mass or higher, the Ni alloy used to form the electrode base metal 10 generates a $Cr_2O_3$ protective film (hereinafter, may be referred to merely as a protective film) in an oxidizing atmosphere, whereby oxidation resistance can be enhanced. The $Cr_2O_3$ protective film is formed on the surface of the electrode base metal 10 and on the surface of the weld zone 11. The surfaces are not a contact surface between the electrode base metal 10 and the weld zone 11, but are external surfaces to be exposed to an oxidizing atmosphere. By virtue of having an Al content of 1.5% by mass or higher, the Ni alloy used to form the electrode base metal 10 can enhance adhesion of the $Cr_2O_3$ protective film and can enhance oxidation resistance through formation of $Al_2O_3$ under the $Cr_2O_3$ protective film. Meanwhile, in the case where the Ni alloy used to form the electrode base metal 10 contains Cr in an amount less than 15% by mass or Al in an amount less than 1.5% by mass, the surface of the electrode base metal 10 is apt to be oxidized. In the case where the Ni alloy used to form the electrode base metal 10 contains Cr in excess of 30% by mass, a Ni—Cr intermetallic compound is generated, thereby accelerating internal oxidation. In the case where the Ni alloy used to form the electrode base metal 10 contains Al in excess of 4% by mass, $Al_2O_3$ dots the surface of the electrode base metal 10 in precedence over the $Cr_2O_3$ protective film. Thus, the formation of a uniform $Cr_2O_3$ protective film on the surface of the electrode base metal fails, thereby accelerating oxidation. As mentioned above, when the Cr content or the Al content of the Ni alloy used to form the electrode base metal 10 falls outside the above-mentioned ranges, the electrode base metal 10 is apt to be oxidized; consequently, the volume of the electrode base metal is reduced; i.e., the thickness of the electrode base metal around the noble metal chip may be reduced.

FIGS. 2(*a*) and 2(*b*) are enlarged half sectional, explanatory views showing the state of joint between the noble metal chip and the electrode base metal as viewed before and after exposure to thermal cycles within an internal combustion engine. In comparison between an electrode base metal 210*a* before exposure to thermal cycles shown in FIG. 2(*a*) and an electrode base metal 210*b* after exposure to thermal cycles shown in FIG. 2(*b*), the electrode base metal 210*b* after exposure to thermal cycles is thinner by thickness B. A reduction in the thickness of the electrode base metal 210*a* (210*b*) is caused by oxidation of the electrode base metal 210*a* (210*b*). A circular columnar noble metal chip 25*a* (25*b*) is joined to the electrode base metal 210*a* (210*b*) in such a manner as to project from the surface of the electrode base metal 210*a* (210*b*). As shown in FIGS. 2(*a*) and 2(*b*), when the thickness of the electrode base metal 210*b* is reduced by thickness B as a result of exposure to thermal cycles, the amount of projection of the noble metal chip 25*b* increases by thickness B. Then, when a weld zone 211*b* has a weak point in relation to imposition of an external force on the noble metal chip 25*b*; for example, the weld zone 211*b* has a crack, thermal cycles and impact associated with firing is likely to cause the noble metal chip 25*b* to break and to become detached from the electrode base metal 210*b*. Further, when a Ni alloy used to form the electrode base metal 210*a* (210*b*) contains Cr in excess of 30% by mass and Al in excess of 4% by mass, the Ni alloy is solution-hardened, causing difficulty in wire drawing and bending. Thus, such a composition is undesirable for formation of the electrode base metal 210*a* (210*b*) having a shape resembling the letter L. A Ni alloy used to form the electrode base metal 210*a* (210*b*) may contain Si as an unavoidable impurity.

A reduction in thickness of the electrode base metal stemming from exposure to thermal cycles within an internal combustion engine can be obtained as follows. The thickness of the electrode base metal before exposure to thermal cycles and the thickness of the electrode base metal after exposure to thermal cycles are measured. The difference between the measured thicknesses is calculated, thereby yielding a thickness differential B between the electrode base metal before exposure to thermal cycles and the electrode base metal after exposure to thermal cycles.

The average hardness of the electrode base metal 10 is preferably Hv150 to Hv220 inclusive, particularly preferably Hv160 to Hv220 inclusive. When the average hardness of the electrode base metal 10 falls within the aforementioned range, there can be prevented the breakage of the electrode base metal 10, which could otherwise result from exposure to heat and vibration within an engine. Also, vibration of the electrode base metal 10 is restrained by virtue of high rigidity, whereby there can be prevented an extension of cracking generated in the internal oxidation layer 312 in the interface between the noble metal chip 35 and the weld zone 311. Further, when the hardness of the electrode base metal falls within the aforementioned range, the following particular effect is yielded: the electrode base metal having a shape resembling the letter L or a gently semicircularly curved shape is unlikely to be broken at a bend.

The average hardness of the electrode base metal can be measured as follows. In an arbitrary area on a section of the electrode base metal cut by a plane orthogonal to a central axis extending along the longitudinal direction of the electrode base metal, an arbitrary number of measuring points are selected, and hardness is measured at the measuring points. The measured values in the arbitrary number are averaged, thereby yielding an average hardness. For efficient measurement of the hardness of the electrode base metal, the hardness of the weld zone, and the average hardness of the center electrode, an end portion of the electrode base metal to which the noble metal chip is welded with the weld zone formed therebetween, together with the noble metal chip and the weld zone, is cut such that the resultant section contains the central axis of the noble metal chip. In the resultant section of the electrode base metal, an arbitrary number of hardness measuring points are selected. The hardness of the electrode base metal is measured at the hardness measuring points according to JIS Z 2244 by use of a micro Vickers hardness meter under a load of 0.5 N. The measured hardnesses in the arbitrary number are averaged, thereby yielding an average hardness of the electrode base metal. The number of hardness measuring points is 4 to 16. Usually, nine points arranged at equal intervals in three columns and three rows are preferred.

As shown in FIGS. 1(*a*) and 1(*b*), the noble metal chip 5 of the ground electrode 6 usually has a circular columnar shape (i.e., cylindrical shape) and preferably has a diameter of 0.5 mm to 2.0 mm and a height of 0.4 mm to 1.5 mm. The size of the noble metal chip 5 preferably falls within the above-mentioned ranges in view of ignitability, heat radiation performance, and joint performance, whereby excellent durability can be imparted to the spark plug 1.

The noble metal chip 9 joined to the center electrode 2, and the noble metal chip 5 joined to the electrode base metal 10 are formed from a noble metal, such as Pt, a Pt alloy, Ir, or an Ir alloy. Examples of such a noble metal chip include a Pt alloy chip which contains Pt as a main component, and at least one of Ir, Rh, Nb, W, Pd, Re, Ru, and Os, and an Ir alloy chip which contains Ir as a main component, and at least one of Pt, Rh, Nb, W, Pd, Re, Ru, and Os. In the case of a main component of Pt or Ir, another or other components are added preferably in a range of 5% by mass to 50% by mass.

The noble metal chip 5 joined to the electrode base metal 10 is placed in an environment that is more severe in temperature fluctuations than the environment in which the noble metal chip 9 joined to the center electrode 2 is placed. Thus, as will be described later, through specification of properties of the noble metal chip 5, durability of the noble metal chip 5 is necessary to be enhanced.

The noble metal chip 5 joined to the electrode base metal 10 has an average hardness of 260 to 650 inclusive, preferably 260 to 550 inclusive. When the noble metal chip 5 is welded to the electrode base metal 10, an external load is usually imposed on the noble metal chip. Examples of such an external load include stress generated in association with handling, thermal shock during welding, and an accidental shock, such as contact with a jig or drop in the course of manufacture of the spark plug 1. When the average hardness of the noble metal chip is less than 260, stress generated in association with handling or mechanical stress generated from an accidental collision or the like may cause deformation of the noble metal chip 5. When the average hardness of the noble metal chip is more than 650, the mechanical stress may cause chipping of the noble metal chip, and thermal shock during welding may cause cracking of the noble metal chip.

The average hardness of the noble metal chip can be measured as follows. In an arbitrary area on a section of the noble metal chip cut in such a manner that the section contains a central axis extending along the longitudinal direction of the noble metal chip, an arbitrary number of measuring points are selected, and hardness is measured at the measuring points. The measured values in the arbitrary number are averaged, thereby yielding an average hardness. For efficient measurement of the hardness of the electrode base metal, the hardness of the weld zone, and the average hardness of the center electrode, an end portion of the electrode base metal to which the noble metal chip is welded with the weld zone formed therebetween, together with the noble metal chip and the weld zone, is cut such that the resultant section contains the central axis of the noble metal chip. In the resultant section of the noble metal chip, an arbitrary number of hardness measuring points are selected. The hardness of the noble metal chip is measured at the hardness measuring points according to JIS Z 2244 by use of a micro Vickers hardness meter under a load of 0.5 N. The measured hardnesses in the arbitrary number are averaged, thereby yielding an average hardness of the noble metal chip. The number of hardness measuring points is 4 to 16. Usually, nine points arranged at equal intervals in three columns and three rows are preferred.

In the case where the noble metal chip is not yet joined to the electrode base metal, hardness may be measured as follows. The noble metal chip is cut such that the resultant section contains the central axis of the noble metal chip, and hardness is measured on the section of the noble metal chip.

A method of fabricating the noble metal chip is described below. In fabrication of the noble metal chip, an ingot of a noble metal material is subjected to working selected from hot or cold forging, rolling, swaging, blanking, and wire drawing. Strain generated in association with such working increases the hardness of the noble metal chip, which is called work hardening. Preferably, the noble metal chip is fabricated by the following method, rather than by a sintering method: an ingot is cast by a melting method using an arc melting furnace or the like; then, the noble metal chip is fabricated from the ingot by means of the above-mentioned working accompanied by work hardening. According to the sintering method, a noble metal powder having a required composition is compacted into a green noble metal chip having a required shape, followed by firing. The sintering method involves difficulty in homogenizing the composition of the noble metal chip. Also, the noble metal chip fabricated by the sintering method is fragile and is thus apt to be chipped; thus, a drawback of poor durability is involved. Meanwhile, when the noble metal chip is fabricated by means of the melting method and the above-mentioned working, and an average hardness falling within the aforementioned range is imparted to the noble metal chip through work hardening, the noble metal chip has internal strain. When the noble metal chip is exposed to high temperature associated with operation of an engine, the strain is eliminated, and the material of the noble metal chip is recrystallized, thereby refining structure. Refined structure can restrain loss of grain boundaries, which could otherwise result from exposure to thermal cycles. Thus, durability of the noble metal chip in a thermal cycle environment can be enhanced.

Preferably, in the course of fabrication of the noble metal chip, after hot or cold forging, rolling, or swaging, work hardening is effected through blanking or wire drawing. A wire formed through wire drawing shows a fibrous structure along the wire-drawing direction; i.e., the longitudinal direction. Thus, preferably, the wire is cut into pieces each having a required length, and the piece is welded to the electrode base metal 10 while the cut surface is in contact with a side surface of the electrode base metal 10. This is for the following reason. When the noble metal chip and the electrode base metal are welded, generally, thermal residual stress is generated. In the present embodiment, since the noble metal chip is lower in thermal expansion coefficient than the electrode base metal, tensile stress is generated mainly on the side surface of the noble metal chip. As a result, the noble metal chip is susceptible to cracking. However, when the noble metal chip is welded to the electrode base metal in such a manner that the fibrous structure yielded through wire drawing and extending in the wire-drawing direction is perpendicular to the contact surface between the electrode base metal and the noble metal chip, there can be prevented cracking of the noble metal chip, which could otherwise result from the tensile stress. Generally, the thicker (longer) the noble metal chip, the more preferred is a wire drawing process for fabrication of the noble metal chip. Also, the wire drawing process is preferred for the reason of excellent dimensional accuracy with respect to the longitudinal and radial directions. Meanwhile, in fabrication of a thin noble metal chip, cutting with a grindstone is highly likely to cause deformation of the noble metal chip due to resistance of the grindstone; thus, blanking is preferred for fabrication of a thin noble metal chip. In a blanking process, a thin noble metal chip is blanked out, by use of a die, from a sheet formed through aforementioned forging or rolling. In the case of a thin noble metal chip, the aforementioned thermal residual stress assumes the form of tensile stress along a direction in parallel with a welding surface. The noble metal chip obtained through blanking has a metallographic structure oriented in parallel with the welding surface. Thus, cracking of the noble metal chip, which could otherwise result from the residual stress, can be prevented.

Since the noble metal chip 5 is welded to the electrode base metal 10 by laser welding or electric resistance welding, the weld zone 11 is formed at the boundary between the noble metal chip 5 and the electrode base metal 10 through fusion of the noble metal chip 5 and the electrode base metal 10.

The weld zone 11 is formed as a result of execution of the above-mentioned welding on the electrode base metal 10 and the noble metal chip 5. Accordingly, the weld metal zone 11 is formed from a substance derived from both of a substance used to form the electrode base metal and a substance used to form the noble metal chip.

The composition of thus-formed weld zone 11 is such that the total mass of Ni, Cr, Al, Si, and Fe is 5% by mass to 35% by mass inclusive, preferably 10% by mass to 32% by mass inclusive, with respect to the total mass of the weld zone.

Also, the composition of the weld metal zone 11 is such that the total mass of Cr, Al, Si, and Fe is preferably 3% by mass to 9.5% by mass inclusive, more preferably 5% by mass to 8% by mass inclusive, with respect to the total mass of the weld zone.

Further, the composition of the weld zone 11 is such that the total mass of Cr, Al, and Si is preferably 2% by mass to 4% by mass inclusive, more preferably 3.5% by mass to 3.8% by mass inclusive, with respect to the total mass of the weld zone.

When the composition of the weld zone 11 satisfies the above-mentioned ranges, as shown in FIG. 3, it is possible to prevent a generation of the internal oxidation layer 312 in the interface between the noble metal chip 35 and the weld zone 311. Thus, even in an exposure to thermal cycles in the internal combustion engine, cracking generated in the internal oxidation layer 312 can be prevented. Accordingly, there can be prevented separation or detachment, which is caused by cracking, of the noble metal chip 35 from the electrode base metal 310. As a result, a spark plug having good joint performance between the electrode base metal and the noble metal chip can be provided.

A cause for generation of the internal oxidation layer 312 between the noble metal chip 35 and the weld zone 311 is that an oxygen diffusion velocity of a noble metal is very fast as compared to an oxygen diffusion velocity of Ni which is slow (compared to the noble metal). Since the oxygen diffusion velocity of the noble metal is very fast, oxygen is diffused and approaches (migrates) from the noble metal tip 35 to inside, i.e., the weld zone 311 and the electrode base metal 310. Since the weld zone 311 contains the element contained in the noble metal and a Ni alloy, the oxygen diffusion velocity of the weld zone 311 is slow compared to that of the noble metal tip 35. Therefore, the diffusion rate of the oxygen which is diffused and approaches (migrates) from the noble metal tip 35 falls (reduces) in the weld zone 311, and the oxygen is condensed (i.e., concentrated) in the interface between the noble metal tip 35 and the weld zone 311. Since Cr, Al, Si and Fe, which are contained in the weld zone 311, are easily oxidized compared to Ni, those elements are oxidized by the condensed (concentrated) oxygen, whereby the internal oxidation layer 312 is generated.

When the weld zone of the spark plug according to the present invention has a composition that the total mass of Ni, Cr, Al, Si, and Fe falls within the aforementioned range, the oxygen condensation (concentration) in the interface between the noble metal tip and the weld zone can be prevented. Further, when the total mass of Ni, Cr, Al, Si, and Fe falls within the aforementioned range, the generation of the internal oxidation layer caused by oxidization of these elements can be prevented.

The composition of the weld zone can be determined as follows. A plurality of points are arbitrarily selected on the weld zone. Through utilization of EPMA, WDS (Wavelength Dispersive X-ray Spectrometer) analysis is performed to measure mass composition at the points. Mass compositions measured at the plurality of points are averaged. The obtained average mass composition is taken as the composition of the weld zone.

The average hardness of the weld zone is Hv255 to Hv400 inclusive, preferably Hv280 to Hv350 inclusive. When the average hardness of the weld zone is in excess of Hv400, the weld zone becomes fragile. Consequently, cracking stemming from thermal fatigue is apt to be generated in the weld zone. When the average hardness of the weld zone is less than Hv255, because its low average hardness, the weld zone is apt to have cracking when exposed to thermal cycles in the internal combustion engine which leads to distortion as a result of the difference in thermal expansion coefficient between the noble metal chip and the electrode base metal. By contrast, when the average hardness of the weld zone falls within the aforementioned range, cracking is unlikely to occur in the weld zone. Thus, separation or detachment of the noble metal from the electrode base metal can be prevented. As a result, a spark plug having good joint performance between the electrode base metal and the noble metal chip can be provided.

The generation of cracking in the weld zone can be observed with a metallographic microscope.

The average hardness of the weld zone can be measured as follows. An end portion of the electrode base metal to which the noble metal chip is welded with the weld zone formed therebetween, together with the noble metal chip and the weld zone, is cut such that the resultant section contains the central axis of the noble metal chip. On the resultant section of the weld zone, an arbitrary number of hardness measuring points are selected. The hardness of the weld metal zone is measured at the hardness measuring points according to JIS Z 2244 by use of a micro Vickers hardness meter under a load of 0.5 N. The measured hardnesses in the arbitrary number are averaged, thereby yielding an average hardness of the weld zone. The number of hardness measuring points is 10 to 40. Usually, 30 points are preferred. The number of measuring points for the weld zone is greater than that for the electrode base metal or that for the noble metal chip for the reason of variations of hardness stemming from heat.

In joining of the noble metal chip and the electrode base metal, the noble metal chip can be welded to the electrode base metal by appropriate welding means, such as laser welding or electric resistance welding. Particularly, laser welding is preferred since highly reliable welding strength can be achieved free from influence of, for example, surface roughness of the electrode base metal and the presence of oxide on the surface of the electrode base metal. The noble metal chip and the electrode base metal are joined together as follows. The noble metal chip is placed at a predetermined position on the electrode base metal. A contact portion between the noble metal chip and the electrode base metal is irradiated with a laser beam partially or along the whole circumference from an obliquely upward direction of the noble metal chip. Preferably, the laser beam is radiated along the whole circumference in such a manner that weld metal zones of every radiation of laser beam overlap one another and are arranged at substantially equal intervals, for strong joining of the noble metal chip and the electrode base metal.

Preferably, laser radiation uses a laser beam having laser energy of 2 J/pulse to 8 J/pulse and a unit laser radiation time; i.e., a pulse width, of 3 milliseconds or shorter, particularly 2 milliseconds or shorter. When the laser energy and the pulse width fall within the above-mentioned ranges, the average hardness of the weld zone can be adjusted so as to fall within the aforementioned range.

The composition of the weld zone can be adjusted as follows: while the amount of melting of a noble metal used to form the noble metal chip is held constant by means of maintaining a position on the circumferential surface of the noble metal chip irradiated with laser at a fixed axial height, the amount of melting of an Ni alloy used to form the electrode base metal is increased or decreased. FIG. 4(*a*) is a half sectional, explanatory view showing the noble metal chip and the electrode base metal in the case where the amount of melting of a Ni alloy used to form the electrode base metal is small. FIG. 4(*b*) is a half sectional, explanatory view showing the noble metal chip and the electrode base metal in the case where the amount of melting of a Ni alloy used to form the electrode base metal is large. As shown in FIGS. 4(*a*) and 4(*b*), a distance H of position 414*a* (414*b*) (that is located on the interface between the noble metal chip 45*a* (45*b*) and a weld zone 411*a* (411*b*) and most biased toward a noble-metal-chip side) from contact surface 413*a* (413*b*) (that is defined between a noble metal chip 45*a* (45*b*) and an electrode base metal 410*a* (410*b*)) is fixed. In order to reduce the amount of melting of an Ni alloy used to form the electrode base metal 410*a*, as shown in FIG. 4(*a*), a distance "ha" of a position 415*a* (that is located on the interface between the weld zone 411*a* and the electrode base metal 410*a* and most biased toward an electrode-base-metal-410*a* side) from the contact surface 413*a* (that is defined between the noble metal chip 45*a* and the electrode base metal 410*a*) is reduced. In order to increase the amount of melting of an Ni alloy used to form the electrode base metal 410*b*, as shown in FIG. 4(*b*), a distance "hb" of a position 415*b* (that is located on the interface between the weld zone 411*b* and the electrode base metal 410*b* and most biased toward an electrode-base-metal-410*b* side) from the contact surface 413*b* (that is defined between the noble metal chip 45*b* and the electrode base metal 410*b*) is increased. The distances "ha," "hb" can be increased or decreased by means of adjusting a laser radiation diameter and laser radiation energy.

The weld zone may be formed such that the noble metal chip and the electrode base metal are joined together with a required strength. In the case where the circular columnar noble metal chip is disposed on the ground electrode, the weld zone may be formed along the circumference of a circular contact surface between the noble metal chip and the ground electrode, or at a portion of the circumference. Also, the weld zone may be formed along an entire contact surface 313 between a noble metal chip 35 and an electrode base metal 310 as shown in FIG. 3, or along a portion of the contact surface 313. Preferably, a weld zone 311 is formed along the entire contact surface 313 between the noble metal chip 35 and the electrode base metal 310, since strong joint is established between the noble metal chip 35 and the electrode base metal 310.

Preferably, a distance "H" of a position 314 (that is located on the interface between the noble metal chip 35 and the weld zone 311 and most biased toward a noble-metal-chip-35 side) from the contact surface 313 (that is defined between the noble metal chip 35 and the electrode base metal 310) is 0.3 mm to 0.7 mm. When the distance "H" falls within the above-mentioned range, strong joint can be established between the noble metal chip 35 and the electrode base metal 310, and required ignitability can be maintained.

As mentioned previously, preferably, the average hardness of the noble metal chip 5 is Hv260 to Hv650 inclusive; the average hardness of the weld zone 11 is Hv255 to Hv400 inclusive; and the average hardness of the electrode base metal 10 is Hv150 to Hv220 inclusive. Further, when the above-mentioned ranges of the average hardness are satisfied, the average hardness of the noble metal chip 5 is higher than that of the weld zone 11, and the average hardness of the weld zone 11 is higher than that of the electrode base metal 10. When the noble metal chip 5 is higher in average hardness than the weld zone 11, which in turn is higher in average hardness than the electrode base metal 10, there can be prevented the breakage of the noble metal chip or the cracking generated in the internal oxidation layer 312 of the interface between the noble metal chip 35 and the weld zone 311.

The spark plug 1 is manufactured, for example, as follows. An Ni alloy having the aforementioned composition is formed into a predetermined shape, thereby yielding the electrode base metal 10. Next, one end portion of the electrode base metal 10 is joined, by laser welding or electric resistance welding, to an end portion of the metallic shell 4, which has a predetermined shape imparted thereto through plastic working.

In association with the above-mentioned process, an electrode material, such as an Ni alloy, is formed into a predetermined shape, thereby yielding the center electrode 2. The center electrode 2 is assembled into the insulator 3 having a predetermined shape and predetermined dimensions by a known method. The noble metal chip 9 may be welded to an end surface of the center electrode 2 by laser welding.

Next, the insulator 3 into which the center electrode 2 is assembled is assembled into the metallic shell 4 to which the electrode base metal 10 is joined.

Next, the noble metal chip 5 fabricated through work hardening is welded to an end portion of the electrode base metal 10 opposite the end portion of the electrode base metal 10 joined to the metallic shell 4, by laser welding. Then, the electrode base metal 10 is bent so as to assume a shape resembling the letter L and such that the noble metal chip 5 faces the front end surface or side surface of the center electrode 2 via a spark discharge gap.

Before being joined to the metallic shell 4, the electrode base metal 10 may be bent so as to assume a shape resembling the letter L. Also, the noble metal chip 5 may be joined to an end portion of the electrode base metal 10 after the electrode base metal 10 joined to the metallic shell 4 is bent so as to assume a shape resembling the letter L.

The spark plug of the present invention is not limited to the above-described embodiment, but may be modified in various other forms, so long as the object of the present invention can be achieved. For example, the ground electrode 6 of the spark plug 1 shown in FIG. 1(*b*) is joined to an end portion of the metallic shell 4. However, the ground electrode 6 may be joined to an outer circumferential surface of the metallic shell.

Also, the noble metal chip 9 joined to the center electrode 2 may not be required depending on required performance. In the case where the noble metal chip 9 is joined to the center electrode 2, the noble metal chip 9 can be joined to the center electrode 2 in a manner similar to that for the aforementioned case of joining the electrode base metal 10 and the noble metal chip 5 together.

Figure 5:
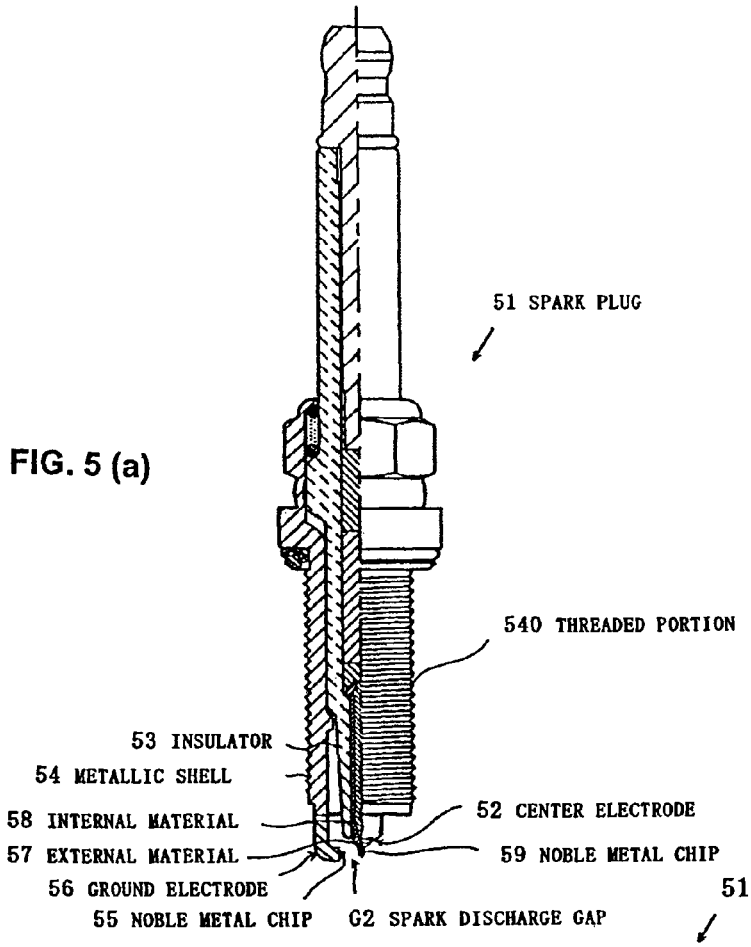
FIG. 5(*a*) is a partially sectional, explanatory view showing an entire spark plug according to another embodiment of the present invention, and FIG. 5(*b*) is a sectional, explanatory view showing essential portions of the spark plug according to the another embodiment of the present invention.
Figure 5:
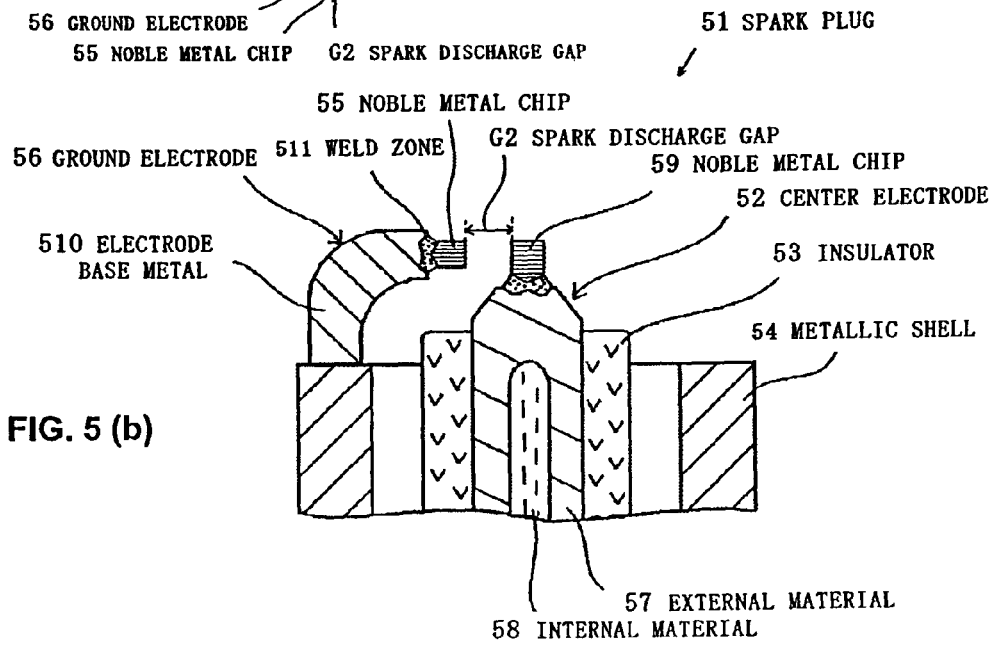

A spark plug according to another embodiment of the present invention is shown in FIGS. 5(*a*) and 5(*b*). FIG. 5(*a*) is a partially sectional, explanatory view showing an entire spark plug according to the another embodiment. FIG. 5(*b*) is a sectional, explanatory view showing essential portions of the spark plug according to the another embodiment. As shown in FIGS. 5(*a*) and 5(*b*), a spark plug 51 includes a center electrode 52; an insulator 53 provided around the periphery of the center electrode 52; a metallic shell 54 which holds the insulator 53; and a ground electrode 56 configured such that one end of the ground electrode 56 is joined to an end portion of the metallic shell 54, a noble metal chip 55 is joined to the other end of the ground electrode 56, and the tip end surface of the noble metal chip 55 and the side surface of the center electrode 52 face each other via a spark discharge gap G2.

The spark plug 51 can be formed similar to the spark plug 1 shown in FIGS. 1(*a*) and 1(*b*) except that the noble metal chip 55 joined to an end surface of the ground electrode 56 opposite an end surface of the ground electrode 56 joined to the metallic shell 54 faces the side surface of a noble metal chip 59 of the center electrode 52.

Figure 6:
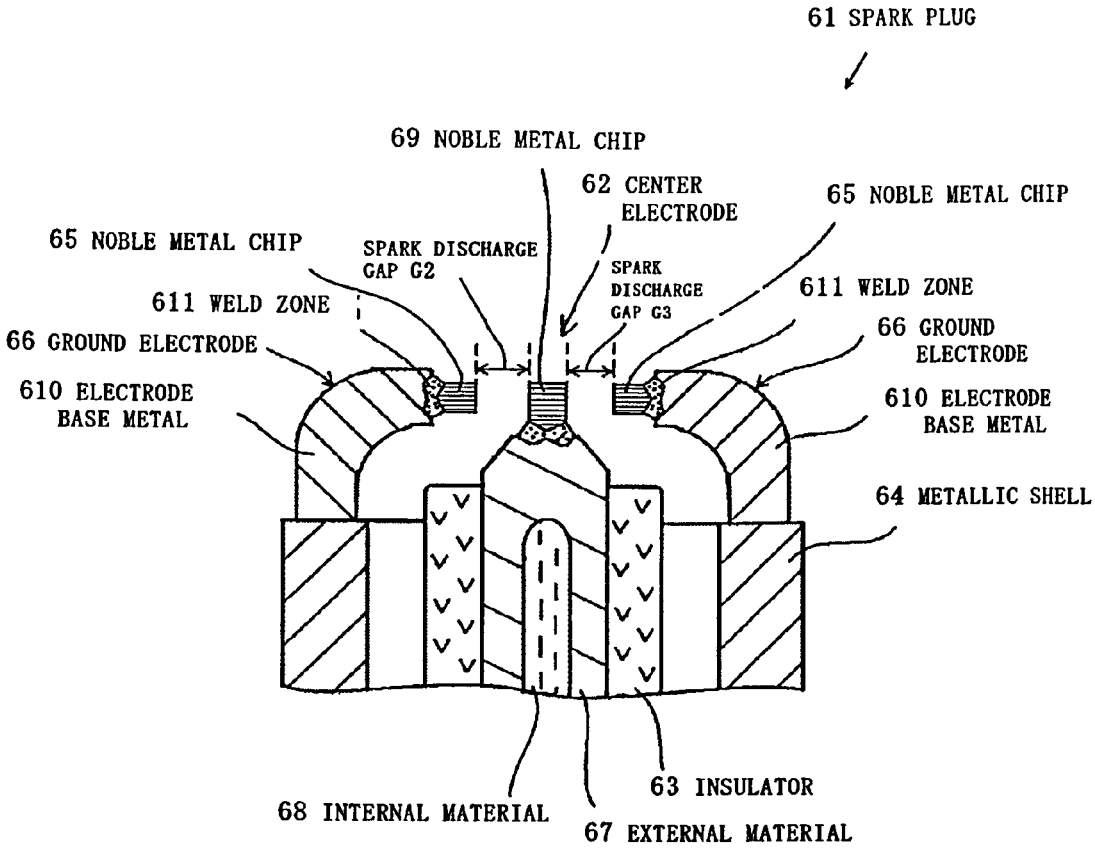
FIG. 6 is a sectional, explanatory view showing essential portions of a spark plug according to a further embodiment of the present invention.

As shown in FIGS. 5(*a*) and 5(*b*), a single ground electrode may be provided, or as shown in FIG. 6, two ground electrodes 66, 66 may be joined to an end portion of a metallic shell 64. Further, although not shown, the following configuration may be employed: three or more ground electrodes are joined to an end surface of a metallic shell, and noble metal chips joined to respective end surfaces of the ground electrodes opposite end surfaces of the ground electrodes joined to the metallic shell face the side surface of a noble metal chip of a center electrode.

The spark plug according to the present invention is used as an ignition plug for an automobile engine and is used in such a manner as to be fixedly inserted into a threaded hole provided in an engine head (not shown) in which combustion chambers of an engine are defined.

EXAMPLES

Fabrication of Spark Plugs

The spark plugs 1 each having a shape similar to that shown in FIGS. 1(*a*) and 1(*b*) were fabricated individually as follows. First, an Ni alloy having a composition to be described later was formed into a rectangular columnar shape, thereby yielding the electrode base metal 10. Next, an end portion of the electrode base metal 10 was joined to an end portion of the metallic shell 4. To the resultant metallic shell 4, the center electrode 2 and the insulator 3 were assembled. In association with the assembly, an ingot of Pt-20% by mass Rh was hot-forged, followed by wire drawing. The resultant wire was cut to form a circular columnar piece such that the wire drawing direction coincides with the height direction of the circular columnar piece, thereby yielding the noble metal chip 5 having a circular columnar shape, a diameter of 0.7 mm, and a height of 1.0 mm. Next, the noble metal chip 5 was fixed on the side surface of an end portion of the electrode base metal 10 opposite the end portion of the electrode base metal 10 joined to the metallic shell 4. The electrode base metal 10 and the noble metal chip 5 were irradiated with a laser beam, thereby being welded together. The electrode base metal 10 was bent so as to assume a shape resembling the letter L and such that the noble metal chip 5 and the front end surface of the center electrode 2 faced each other via a spark discharge gap. The laser beam had laser energy of 4 J/pulse; a unit laser radiation time; i.e., a pulse width, was 2 milliseconds; and laser was radiated at eight points arranged at equal intervals along the whole circumference. The electrode base metal had a rectangular section measuring 1.3 mm (width along the central axis of the noble metal chip)×2.7 mm (width orthogonal to the central axis of the noble metal chip) as cut along the central axis of the noble metal chip and was formed from an Ni alloy having the following composition: Ni: balance; Cr: 15% by mass to 17% by mass; Si: 0.1% by mass to 0.3% by mass; Al: 1.5% by mass to 3.0% by mass; and Fe: 0% by mass to 9.0% by mass.

The composition of the weld zone was adjusted as follows. As shown in FIGS. 4(*a*) and 4(*b*), while the amount of melting of a noble metal used to form the noble metal chip was held constant by means of maintaining a position on the circumferential surface of the noble metal chip irradiated with laser at a fixed axial height, the amount of melting of an Ni alloy used to form the electrode base metal was increased or decreased. The amount of melting of the Ni alloy was controlled through adjustment of a laser radiation diameter.

Thermal Cycle Test

Fabricated spark plug test samples were mounted on a 2,000 cc engine and subjected to a thermal cycle test conducted under the following condition: an operation cycle consisting of one-minute operation at 5,000 rpm and one-minute idling was repeated for 100 hours.

Evaluation Method

The spark plugs 1 which had undergone the thermal cycle test were sectioned perpendicularly to the longitudinal direction of the ground electrodes in such a manner that the sections of the noble metal chips could be observed. The sections were mirror-polished. Table 1 shows the results of measurement regarding the following evaluation items.

1. Composition

The composition of the weld zone 11 of the spark plug 1 was measured as follows. 10 arbitrary points were selected on the weld zone 11. Compositions at the selected points were measured by conducting WDS analysis through utilization of EPMA. Compositions measured at the 10 points were averaged. The obtained average composition was taken as the composition of the weld zone of the spark plug 1. The analysis was conducted at a beam diameter of 50 μm to 100 μm and such that a measuring area fell within the weld zone 11.

2. Hardness

Figure 7:
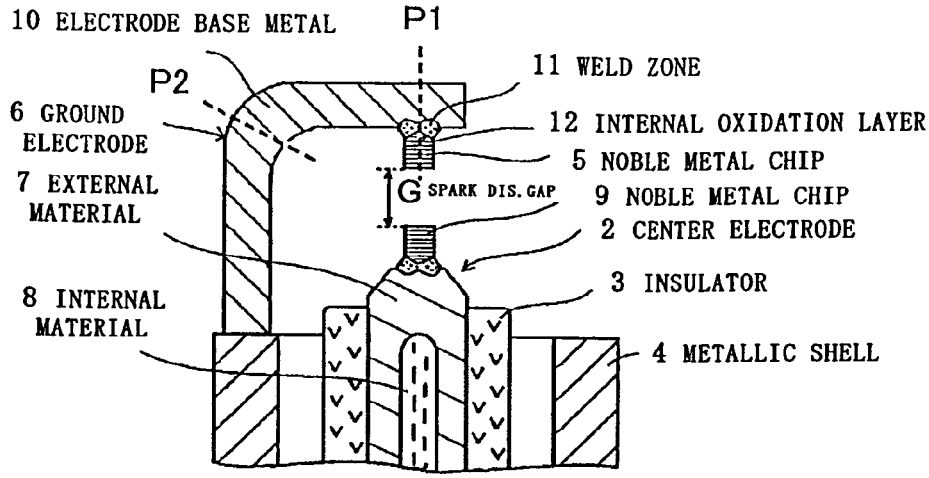
FIG. 7(*a*) is a sectional, explanatory view showing hardness measuring points for the electrode base metal, the weld zone, and the noble metal chip, FIG. 7(*b*) is an explanatory view showing hardness measuring points on a section as cut at P1 in FIG. 7(*a*), and FIG. 7(*c*) is an explanatory view showing hardness measuring points on a section as cut at P2 in FIG. 7(*a*).
Figure 7:
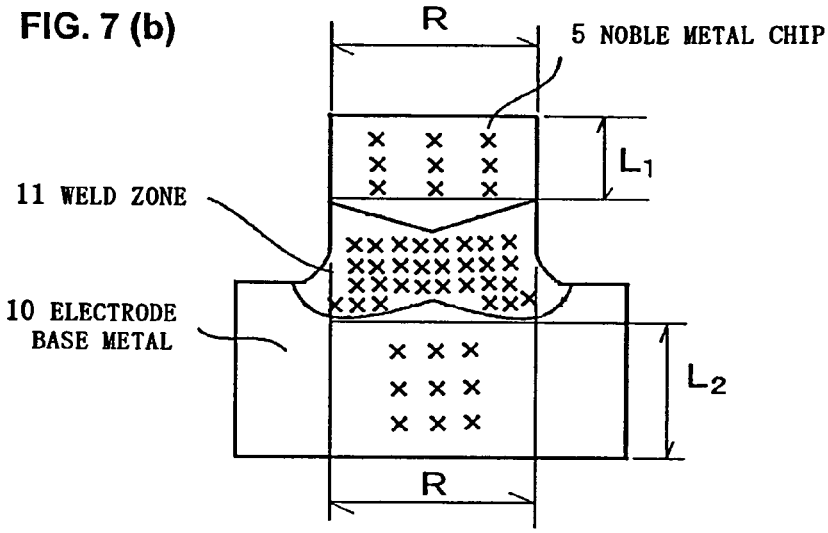
Figure 7:
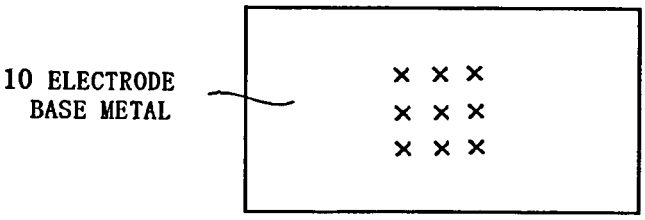

The average hardness of the weld zone 11 of the spark plug 1 was measured as follows. First, the electrode base metal 10, the weld zone 11, and the noble metal chip 5 were cut by a plane which contained a central axis P1 of the noble metal chip 5, which was joined to the electrode base metal 10 with the weld zone 11 formed therebetween as shown in FIG. 7(*a*). On the resultant section (see FIG. 7(*b*)), 30 arbitrary points were selected as shown in FIG. 7(*b*). Micro Vickers hardness was measured at the selected points according to JIS Z 2244 by use of a micro Vickers hardness meter under a load of 0.5 N. The hardnesses measured at the 30 points were averaged. The resultant average hardness was taken as the average hardness of the weld zone of a spark plug test sample.

The average hardness of the noble metal chip 5 was measured as follows. With care not to allow a measuring area and the weld zone 11 to overlap each other, as shown in FIG. 7(*b*), in the area measuring R×L1 on the section of the noble metal chip 5, nine points arranged at equal intervals in three columns and three rows were selected. The hardness of the noble metal chip 5 was measured at the nine points according to JIS Z 2244 by use of a micro Vickers hardness meter under a load of 0.5 N. Next, the hardnesses measured at the nine points were averaged. The resultant average hardness was taken as the average hardness of the noble metal chip 5.

The average hardness of the electrode base metal 10 was measured as follows. With care not to allow a measuring area and the weld zone 11 to overlap each other, as shown in FIG. 7(*b*), in the area measuring R×L2 on the section of the electrode base metal 10, nine points arranged at equal intervals in three columns and three rows were selected. The hardness of the electrode base metal 10 was measured at the nine points according to JIS Z 2244 by use of a micro Vickers hardness meter under a load of 0.5 N. Next, the hardnesses measured at the nine points were averaged. The resultant average hardness was taken as the average hardness of the electrode base metal 10. The average hardness of the electrode base metal may be measured on a section (see FIG. 7(*c*)) of a bend portion denoted by P2 in FIG. 7(*a*).

3. Ratio of Crack Extension

As shown in FIG. 3, a length L of the interface between the noble metal chip 35 and the weld zone 311 and a length of cracking (M and N) were measured by a metallographic microscope. Next, a ratio of the length L of the interface between the noble metal chip 35 and the weld zone 311 with respect to the length of cracking (M and N) was calculated to thereby obtain a ratio of crack extension. In addition, when measuring the length L of the interface between the noble metal chip 35 and the weld zone 311, the interface can be subjected to, for example, etching with a 10% nitric acid solution which clears the interface and provides an easier measurement.

TABLE 1

| | Ni, Cr, Al, Si, Fe total concentration (% by mass) | Cr, Al, Si, Fe total concentration (% by mass) | Cr, Al, Si total concentration (% by mass) | Weld zone hardness (Hv) | Noble metal chip hardness (Hv) | Electrode base metal hardness (Hv) | Ratio of crack extension (%) |
|---|---|---|---|---|---|---|---|
| Comp. Ex. 1 | 2.4 | 0.4 | 0.1 | 421 | 320 | 263 | 73.1 |
| Comp. Ex. 2 | 4.5 | 1.0 | 0.8 | 403 | 655 | 224 | 51.3 |
| Example 1 | 5.2 | 2.1 | 1.1 | 399 | 649 | 216 | 49.4 |
| Example 2 | 7.8 | 3.1 | 1.5 | 384 | 572 | 218 | 47.9 |
| Example 3 | 10.6 | 4.4 | 2.1 | 367 | 552 | 219 | 32.3 |
| Example 4 | 13.1 | 5.3 | 3.0 | 355 | 521 | 203 | 25.8 |

TABLE 1-continued

| | Ni, Cr, Al, Si, Fe total concentration (% by mass) | Cr, Al, Si, Fe total concentration (% by mass) | Cr, Al, Si total concentration (% by mass) | Weld zone hardness (Hv) | Noble metal chip hardness (Hv) | Electrode base metal hardness (Hv) | Ratio of crack extension (%) |
|---|---|---|---|---|---|---|---|
| Example 5 | 14.9 | 5.5 | 3.4 | 347 | 485 | 194 | 18.7 |
| Example 6 | 18.0 | 5.7 | 3.5 | 333 | 448 | 190 | 12.1 |
| Example 7 | 19.9 | 6.1 | 3.7 | 325 | 404 | 182 | 9.7 |
| Example 8 | 22.7 | 6.5 | 3.8 | 309 | 384 | 175 | 8.1 |
| Example 9 | 25.5 | 6.9 | 3.8 | 299 | 361 | 171 | 8.9 |
| Example 10 | 28.0 | 7.7 | 3.9 | 292 | 320 | 169 | 15.1 |
| Example 11 | 30.1 | 8.2 | 3.9 | 265 | 278 | 166 | 26.2 |
| Example 12 | 32.3 | 9.0 | 4.0 | 264 | 267 | 161 | 37.1 |
| Example 13 | 34.2 | 9.5 | 4.0 | 256 | 264 | 157 | 47.0 |
| Example 14 | 34.8 | 9.6 | 4.1 | 255 | 261 | 153 | 50.0 |
| Comp. Ex. 3 | 35.4 | 10.8 | 5.8 | 253 | 255 | 145 | 51.2 |
| Comp. Ex. 4 | 39.9 | 16.2 | 10.0 | 250 | 240 | 145 | 57.2 |

All of the spark plugs 1 which had undergone the thermal cycle test exhibited the presence of cracking in the interface between the weld zone 11 and the noble metal chip 5.

Fabrication of Ground Electrodes

Ni alloys were produced by use of an arc melting furnace while Cr and Al contents were varied. The produced Ni alloys were subjected to wire drawing, thereby yielding the electrode base metals 10 each having a rectangular section measuring 1.3 mm×2.7 mm. Similar to the aforementioned fabrication of the spark plugs 1, the noble metal chips 5 each formed from a Pt-20% by mass Rh alloy and having a diameter of 0.7 mm and a height of 1.0 mm were joined to the respective electrode base metals 10 by means of laser radiation, thereby yielding the ground electrodes 6 having the noble metal chips 5 joined thereto.

Thermal Cycle Test

The fabricated ground electrodes 6 were subjected to a thermal cycle test conducted under the following condition: a thermal cycle consisting of allowing the ground electrodes 6 to stand in the atmosphere of 1,200° C. for 30 minutes and allowing the ground electrodes 6 to stand in the atmosphere of the room temperature for 30 minutes was repeated 100 times.

Evaluation Method

1. Oxidation-Induced Reduction of Thickness

Each of the ground electrodes 6 which had undergone the thermal cycle test was sectioned in such a manner that the section of the noble metal chip 5 could be observed. The thickness of the electrode base metal 10 after the thermal cycle test was measured, by use of a metallurgical microscope, from the ground electrode 6 which had been sectioned in the above-mentioned manner. As shown in FIGS. 2(*a*) and 2(*b*), the difference B between the thickness (1.3 mm) of the electrode base metal as measured before the thermal cycle test and the thickness of the electrode base metal as measured after the thermal cycle test was calculated. The thus-calculated difference B was taken as an oxidation-induced reduction of thickness. The results of the calculation are shown in Table 2.

TABLE 2

| | Ni content | Cr content (% by mass) | Al content (% by mass) | Oxidation-induced reduction of thickness (mm) |
|---|---|---|---|---|
| Comp. Ex. 5 | Balance | 9.0 | 1.3 | 0.33 |
| Comp. Ex. 6 | Balance | 12.0 | 1.5 | 0.29 |

TABLE 2-continued

| | Ni content | Cr content (% by mass) | Al content (% by mass) | Oxidation-induced reduction of thickness (mm) |
|---|---|---|---|---|
| Comp. Ex. 7 | Balance | 14.5 | 1.5 | 0.22 |
| Comp. Ex. 8 | Balance | 15.0 | 1.4 | 0.22 |
| Example 15 | Balance | 15.0 | 1.5 | 0.19 |
| Example 16 | Balance | 21.0 | 2.0 | 0.10 |
| Example 17 | Balance | 27.0 | 3.0 | 0.16 |
| Example 18 | Balance | 30.0 | 4.0 | 0.18 |
| Comp. Ex. 9 | Balance | 30.0 | 4.2 | 0.20 |
| Comp. Ex. 10 | Balance | 30.5 | 1.5 | 0.31 |
| Comp. Ex. 11 | Balance | 33.0 | 4.0 | 0.38 |

The invention claimed is:

1. A spark plug comprising:

a center electrode;

an insulator provided around a periphery of the center electrode;

a metallic shell which holds the insulator; and a ground electrode configured such that one end of an electrode base metal of the ground electrode is joined to an end portion of the metallic shell, a noble metal chip is joined to the other end of the electrode base metal, and a tip end surface of the noble metal chip and a front end surface or a side surface of the center electrode face each other to define a spark discharge gap;

wherein the noble metal chip has an average hardness of Hv260 to Hv650 inclusive imparted thereto through work hardening;

the electrode base metal is formed from an Ni alloy which contains Cr in an amount of 15% by mass to 30% by mass inclusive and Al in an amount of 1.5% by mass to 4% by mass inclusive;

a total mass of Ni, Cr, Al, Si, and Fe contained in a weld zone provided between the noble metal chip and the electrode base metal is 5% by mass to 35% by mass inclusive based on a total mass of the weld metal zone;

a total mass of Cr, Al, Si, and Fe contained in the weld zone is 4.4% by mass to 9.0% by mass inclusive with respect to the total mass of the weld zone;

a total mass of Cr, Al, and Si contained in the weld zone is 2.1% by mass to 4.0% by mass inclusive with respect to the total mass of the weld zone;

the average hardness of the noble metal chip is higher than an average hardness of the weld metal zone, and the average hardness of the weld metal zone is higher than an average hardness of the electrode base metal; and the average hardness of the weld metal zone is Hv255 to Hv400 inclusive.

2. A spark plug according to claim 1, wherein the weld zone is formed through joining of the noble metal chip to the electrode base metal by laser welding, and the laser welding is performed by means of radiating a laser pulse of 3 milliseconds or shorter a plurality of times.

3. A method of manufacturing a spark plug comprising:

a center electrode;

an insulator provided around a periphery of the center electrode;

a metallic shell which holds the insulator; and a ground electrode configured such that one end of its electrode base metal formed from an Ni alloy which contains Cr in an amount of 15% by mass to 30% by mass inclusive and Al in an amount of 1.5% by mass to 4% by mass inclusive is joined to an end portion of the metallic shell, a noble metal chip having an average hardness of Hv260 to Hv650 inclusive imparted thereto through work hardening is joined to the other end of the electrode base metal, and a tip end surface of the noble metal chip and a front end surface or a side surface of the center electrode face each other via a spark discharge gap;

wherein the noble metal chip is joined to an end portion of the electrode base metal opposite an end portion of the electrode base metal joined to the metallic shell, by laser welding in which a laser pulse of 3 milliseconds or shorter is radiated a plurality of times, wherein a total mass of Ni, Cr, Al, Si, and Fe contained in a weld zone provided between the noble metal chip and the electrode base metal is 5% by mass to 35% by mass inclusive based on a total mass of the weld metal zone;

a total mass of Cr, Al, Si, and Fe contained in the weld zone is 4.4% by mass to 9.0% by mass inclusive with respect to the total mass of the weld zone; and a total mass of Cr, Al, and Si contained in the weld zone is 2.1% by mass to 4.0% by mass inclusive with respect to the total mass of the weld zone.

4. A method of manufacturing a spark plug, comprising the steps of:

joining an end portion of an electrode base metal formed from an Ni alloy which contains Cr in an amount of 15% by mass to 30% by mass inclusive and Al in an amount of 1.5% by mass to 4% by mass inclusive, to an end portion of a metallic shell;

assembling a center electrode and an insulator into the metallic shell; and joining a noble metal chip having an average hardness of Hv260 to Hv650 inclusive imparted thereto through work hardening, to an end portion of the electrode base metal opposite the end portion of the electrode base metal joined to the metallic shell, by laser welding in which a laser pulse of 3 milliseconds or shorter is radiated a plurality of times, wherein a total mass of Ni, Cr, Al, Si, and Fe contained in a weld zone provided between the noble metal chip and the electrode base metal is 5% by mass to 35% by mass inclusive based on a total mass of the weld metal zone;

a total mass of Cr, Al, Si, and Fe contained in the weld zone is 4.4% by mass to 9.0% by mass inclusive with respect to the total mass of the weld zone; and a total mass of Cr, Al, and Si contained in the weld zone is 2.1% by mass to 4.0% by mass inclusive with respect to the total mass of the weld zone.

* * * * *